US009664074B2

(12) United States Patent
Tolbert et al.

(10) Patent No.: US 9,664,074 B2
(45) Date of Patent: May 30, 2017

(54) VARIABLE VALVE TIMING DEVICE FOR INTERNAL COMBUSTION ENGINES UTILIZING HYDRAULIC VALVE ACTUATORS

(76) Inventors: Joshua Aaron Tolbert, Tuscaloosa, AL (US); Robert Tracy Tolbert, Arley, AL (US); Benjamin Jeffrey Tolbert, Tuscaloosa, AL (US)

( * ) Notice: Subject to any disclaimer, the term of this patent is extended or adjusted under 35 U.S.C. 154(b) by 733 days.

(21) Appl. No.: 13/026,843

(22) Filed: Feb. 14, 2011

(65) Prior Publication Data

US 2012/0204825 A1 Aug. 16, 2012

(51) Int. Cl.
*F01L 1/34* (2006.01)
*F01L 9/02* (2006.01)
*F01L 1/344* (2006.01)

(52) U.S. Cl.
CPC ..... *F01L 9/021* (2013.01); *F01L 1/344* (2013.01)

(58) Field of Classification Search
CPC ... F01L 1/022; F01L 1/34; F01L 1/344; F01L 1/3442; F01L 9/02; F01L 9/021; F01L 9/025; F01L 2001/34426; F01L 2001/34446; F01L 2800/00; F01L 1/047; F01L 1/053; F01L 1/14; F01L 1/146; F01L 1/18; F01L 1/185; F01L 2105/02; F01L 2107/00; F01L 1/267; F01L 13/0005; F01L 2105/00; F15B 7/003; F15B 7/005; F15B 7/008; B21D 53/845; B23P 2700/02; F16C 13/006; F16H 53/025; F16H 53/02; F16H 53/06
USPC ..... 123/90.15, 90.12, 90.17, 90.16, 90.44; 60/539; 74/567, 569
See application file for complete search history.

(56) References Cited

U.S. PATENT DOCUMENTS

2002/0056427 A1* 5/2002 Lee ..... 123/90.17
2002/0108591 A1* 8/2002 Lou ..... 123/90.12
2010/0175645 A1* 7/2010 Berger ..... 123/90.15

* cited by examiner

*Primary Examiner* — Zelalem Eshete

(57) ABSTRACT

A variable valve timing device for an engine utilizing hydraulically actuated valves. A cam follower block, complete with radial bores, and cam followers within these bores, is pivotally mounted about a rotating camshaft. The rotating camshaft displaces the cam followers within the bores, causing the followers to displace hydraulic fluid, forcing movement of either, an intake or exhaust valve, by hydraulic force on a secondary hydraulic cylinder. The cam follower block angular position about the camshaft is mechanically adjustable during operation. Separate cam follower blocks are used for intake and exhaust valve operation such that the valve timing of the intake and exhaust valves can be changed independently.

10 Claims, 5 Drawing Sheets

VARIABLE VALVE TIMING DEVICE FOR INTERNAL COMBUSTION ENGINES UTILIZING HYDRAULIC VALVE ACTUATORS

CROSS-REFERENCE TO RELATED APPLICATIONS (Not Applicable)

STATEMENT REGARDING FEDERALLY SPONSORED RESEARCH OR DEVELOPMENT (Not Applicable)

THE NAMES OF THE PARTIES TO A JOINT RESEARCH AGREEMENT (Not Applicable)

INCORPORATION-BY-REFERENCE OF MATERIAL SUBMITTED ON A COMPANT DISC (Not Applicable)

SEQUENCE LISTING (Not Applicable)

BACKGROUND OF THE INVENTION

Field of the Invention

The present invention relates generally to a variable valve timing arrangement for engines and more specifically to cam follower location in such an arrangement in order to vary valve events of intake and exhaust valves independently from one another.

Background

Internal combustion engines provide the power for the majority of modes of transportation here in the United States. In today's time, with dwindling fossil fuel supplies and environmental concerns, the emphasis placed on creating higher quality and more efficient engines has never been higher. In recent decades, there has been much emphasis placed on improving the control and operation of the valve train of an internal combustion engine due to its influence on the efficiency, emissions, power and overall performance of the engine. The primary reason that valve train has such significant effects on engine operation is that it primarily determines the volumetric efficiency of the engine. Volumetric efficiency is effectively how well the cylinder is filled with air and fuel.

The design of a valve train determines several parameters that can affect the operation of an engine. Ideally, these parameters could be modified or altered real-time during the operation of the engine to meet the ever-changing requirements of the engine. One of these parameters is valve timing. Valve timing is described as the opening and closing points of valve events as measured in crankshaft degrees. The combination of intake and exhaust valve timing is significant in the way in which an engine performs. Lobe separation angle (LSA), is described as the separation angle (in degrees of camshaft rotation) between the centerline of the intake valve event and the centerline of the exhaust valve event.

This parameter has numerous effects on the operation of the engine. The following is a list of some of the effects of varying LSA:

Increasing Lobe Separation Angle

1. Broadens power band.
2. Decreases peak torque.
3. Reduces maximum cylinder pressure.
4. Decreases the likelihood of detonation.
5. Decreases cranking compression.
6. Idle vacuum is increased.
7. Idle quality is increased.
8. Piston-to-valve clearance is increased.
9. Valve overlap is decreased.

Decreasing Lobe Separation Angle (LSA)

1. Narrows power band.
2. Increases peak torque.
3. Increases maximum cylinder pressure.
4. Increases the likelihood of detonation.
5. Increases cranking compression.
6. Idle vacuum is decreased.
7. Idle quality is decreased.
8. Piston to valve clearance is decreased.
9. Valve overlap is increased.

Optimal valve overlap varies substantially with engine speed and thus being able to change this parameter as engine speed changes would be very beneficial to the overall performance of an engine.

RELATED ART

Until this invention, many attempts at variable valve timing had been attempted by several different inventors, including a majority of the Original Equipment Manufacturers (OEM). Some of these inventions are complicated with several parts that would be costly to manufacture, difficult to incorporate into the design of an engine and would likely be unreliable. Others simply do not control the valve events as desired, merely shortening or lengthening the valve event but not changing lobe separation angle. Most of these designs change valve timing with side effects of changes in valve lift and duration. Despite the number of attempts, the need for an improved variable valve timing (VVT) device still exists.

This invention differs from all previous in a variety of ways. Although previous inventions have included ideas and methods of variable valve timing (VVT), none of which allow complete, infinitely variable valve timing of the intake and exhaust valve events, independent of one another, without using multiple camshafts, multiple differing camshaft lobes per cylinder and/or changing the angular position of said camshaft(s) with respect to the relationship of the crankshaft. Some designs have used multiple differing intake or exhaust camshaft lobes per cylinder that may allow the altering of valve timing by switching between lobes or "cam switching", as it has sometimes been called. In addition, unlike many other VVT type inventions, this invention allows variable intake and exhaust valve timing independent of one another as well as independent of lift and duration.

This invention does not require employing multiple camshafts, any of which exclusively operate intake or exhaust valves such that the valve timing can be varied independently by changing the relative angular position of these camshafts as found in Okui's and Uchida's U.S. Pat. No. 6,367,435 granted Apr. 9, 2002 among others.

This invention does not employ multiple intake or exhaust camshaft lobes per cylinder such that the valves be operated by different lobes at different times, commonly referred to "cam switching", to change valve timing as found in Otobe's U.S. Pat. No. 4,876,995 granted Oct. 31, 1989, Miura's U.S. Pat. No. 6,772,731 granted Aug. 10, 2004, as well as Sugiuchi's and Kamiyama's U.S. Pat. No. 5,159,905 among many others of similar design and concept.

This invention allows infinitely variable intake and exhaust valve timing independent of one another, as well as independent of lift and duration. The following inventions successfully vary valve timing but with a side-effect of altering valve lift and duration. Rhoads' U.S. Pat. No. 4,656,976 granted Apr. 14, 1987, Pruzan's U.S. Pat. No. 4,716,863 granted Jan. 5, 1988, and Barnard's U.S. Pat. No. 5,857,438 granted Jan. 12, 1999, among others in similar design and concept. Also, while these inventions change the valve opening timing and valve closing timing, the centerline of the valve event is not altered. The valve events are merely lengthened or shortened such that the timing of the opening and closing of the valves may be changed. That is, the lobe separation angle (LSA) of the camshaft remains the same and therefore the relation between the centerline of the intake valve and exhaust valve events remain unchanged.

In conclusion, this invention differs from all others known in that it is able to achieve independent intake and exhaust valve timing independent of one another (not simply opening and closing but the entire valve event), independent of valve lift and duration while remaining relatively simple without employing multiple camshafts and/or switching between lobes. In effect, the lobe separation angle (LSA) and installed centerline angle (ICA) of the camshaft can be altered real-time during the operation of an internal combustion engine; thus changing the centerline of the intake and exhaust valve events relative to the crankshaft angular position and substantially improving the operation of the engine.

BRIEF SUMMARY OF THE INVENTION

The present invention is a device consisting of distinct components, modules or sections, assembled into one assembly comprising the entire invention. The components include the block, complete with bores, the lifters, fitted to the bores, the camshaft (whether a two lobe design for use with radial type blocks or a multi intake, multi exhaust lobe camshaft for use with blocks of an inline type arrangement), a mechanism for each block to rotate angularly but independently of the other to not only vary the intake and exhaust valve timing (advance and/or retard each one independently) but also to effectively vary the lobe separation angle of the camshaft, if so desired. Hybrid arrangements of each can be incorporated with (as an example) a singular intake lobe for use with a radial type of block and a multi lobe exhaust cam for use with an inline exhaust block or vice versa. Any combination of the two is possible in the present invention. The operation of the invention is that the camshaft inside the invention's block is driven directly in some manner by the engine's crankshaft, rotating at exactly one-half the speed of the crankshaft. The camshaft inside the invention rotates such that the lobe of the camshaft moves the lifters in the bores of the block by direct pressure, causing the lifters to displace hydraulic fluid, forcing movement of the intake and exhaust valves, respectively, by hydraulic force. Rotating these blocks with respect to the camshaft will directly change valve timing. Rotating the blocks opposite the direction of camshaft rotation will advance the timing; rotation in the same direction of camshaft rotation will retard the timing. By retarding or advancing the exhaust valves and intake valves different amounts, one can effectively change lobe separation angle of the camshaft. The system can be designed and manufactured such that individual valves can be retarded or advanced independently of the remainder. A form of modulation (to be presented in subsequent patent filings) may be fitted to either this invention or the hydraulic valve actuator, thereby varying the lift and duration of either the intake valves, (collectively or independently) the exhaust valves (collectively or independently) or both. The modulation device may also be fitted independently between the variable valve timing device and the hydraulic valve actuators such that that the modulation takes place at the valve actuators.

DETAILED DESCRIPTION OF THE INVENTION

Figure 1:
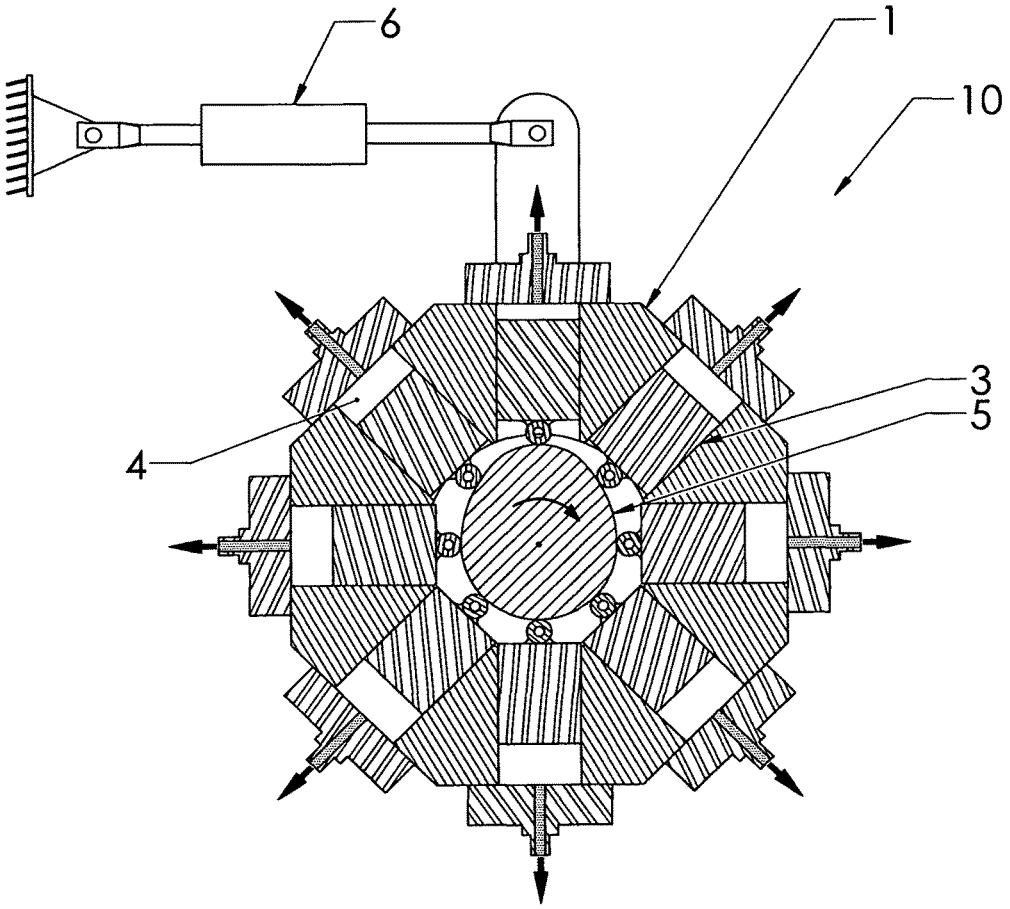
FIG. 1 shows a general schematic (with the valve block sectioned) of the present invention as it may look in one of the possible arrangements (radial type). This figure shows the rotation of a camshaft internal to the radial block of the present invention. The figure shows the rotation of the camshaft displacing the camshaft followers, [[lifters]] and in turn, displacing the hydraulic fluid. The figure also shows a possible arrangement of how the actuator may be oriented to rotate the block.
Figure 2:
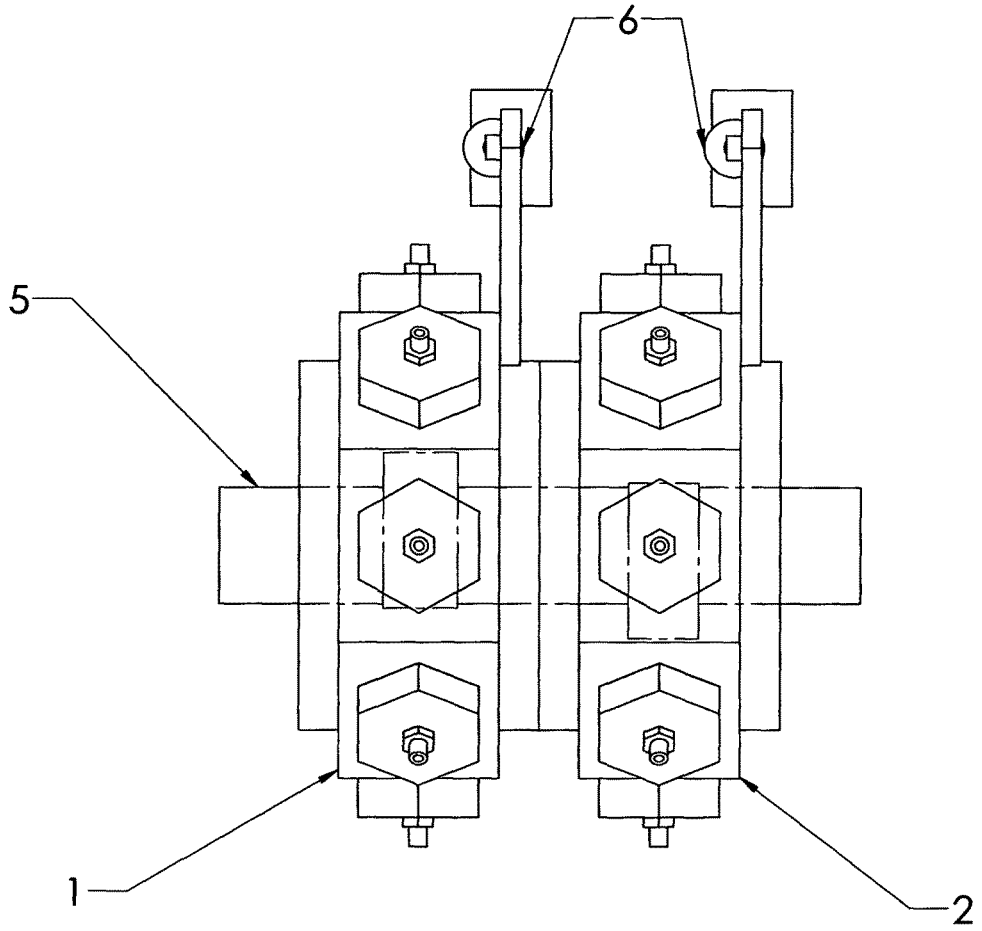
FIG. 2 shows a side view of the radial arrangement. This figure also shows the separate blocks for the intake and exhaust valves to illustrate how they may be adjusted individually and independently.
Figure 3:
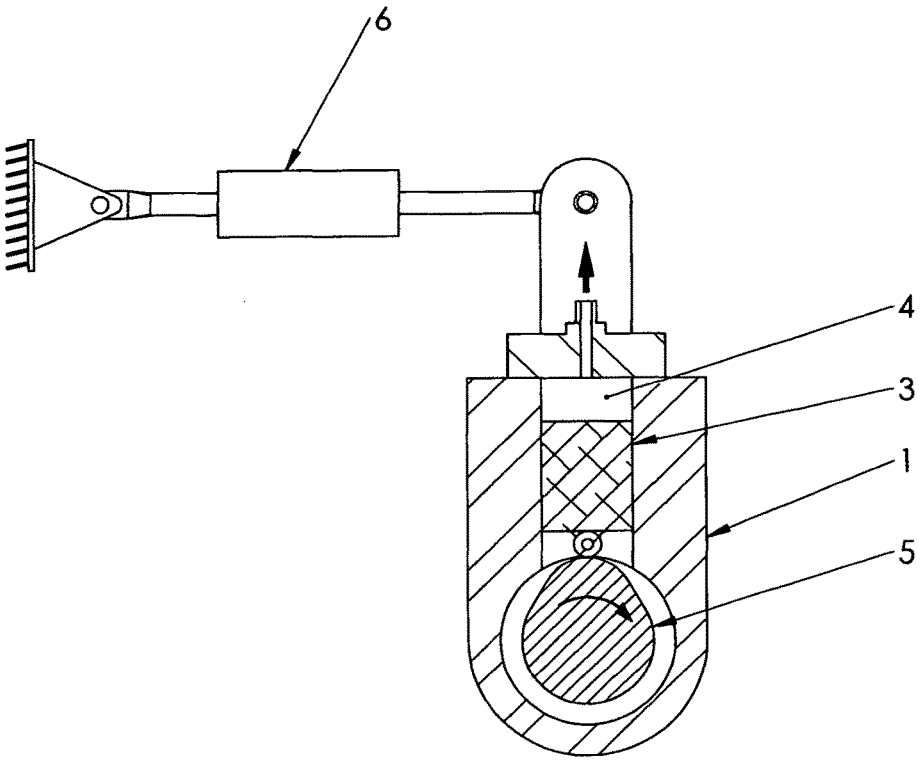
FIG. 3 shows is a general schematic (with the valve block sectioned) of the present invention as it may look in one of the possible arrangements (inline or single type). This figure shows the rotation of a camshaft internal to the radial block of the present invention. The figure shows the rotation of the camshaft displacing the camshaft followers, and in turn, displacing the hydraulic fluid. The figure also shows a possible arrangement of how the actuator may be oriented to rotate the block.
Figure 4:
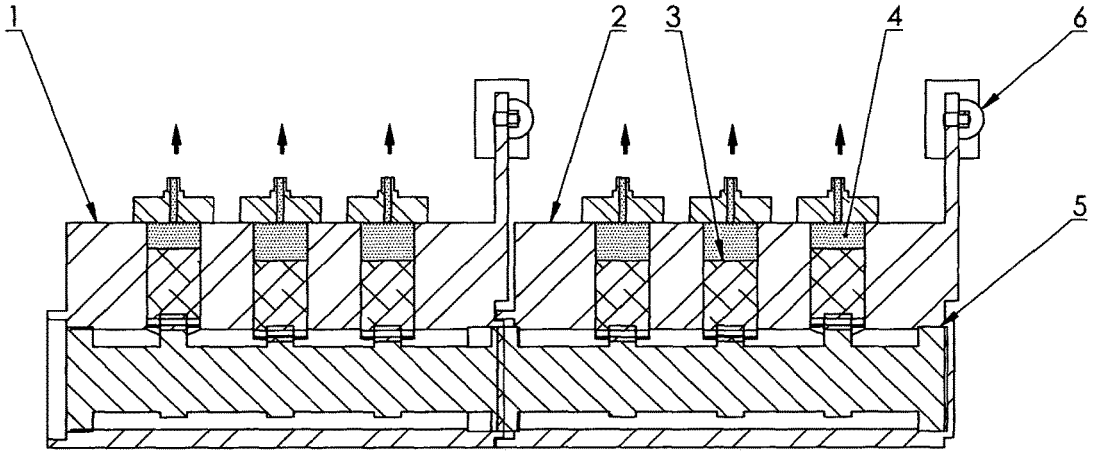
FIG. 4 shows is a side view of the inline or single arrangement, with the valve blocks being sectioned. This figure illustrates the present invention as it may look in one of the possible arrangements (inline or single type). This figure shows the rotation of a camshaft internal to the inline block of the present invention. The figure shows the rotation of the camshaft displacing the camshaft followers, and in turn, displacing the hydraulic fluid. This figure also shows the separate valve blocks for the intake and exhaust valves to illustrate how they may be adjusted individually and independently.
Figure 5:
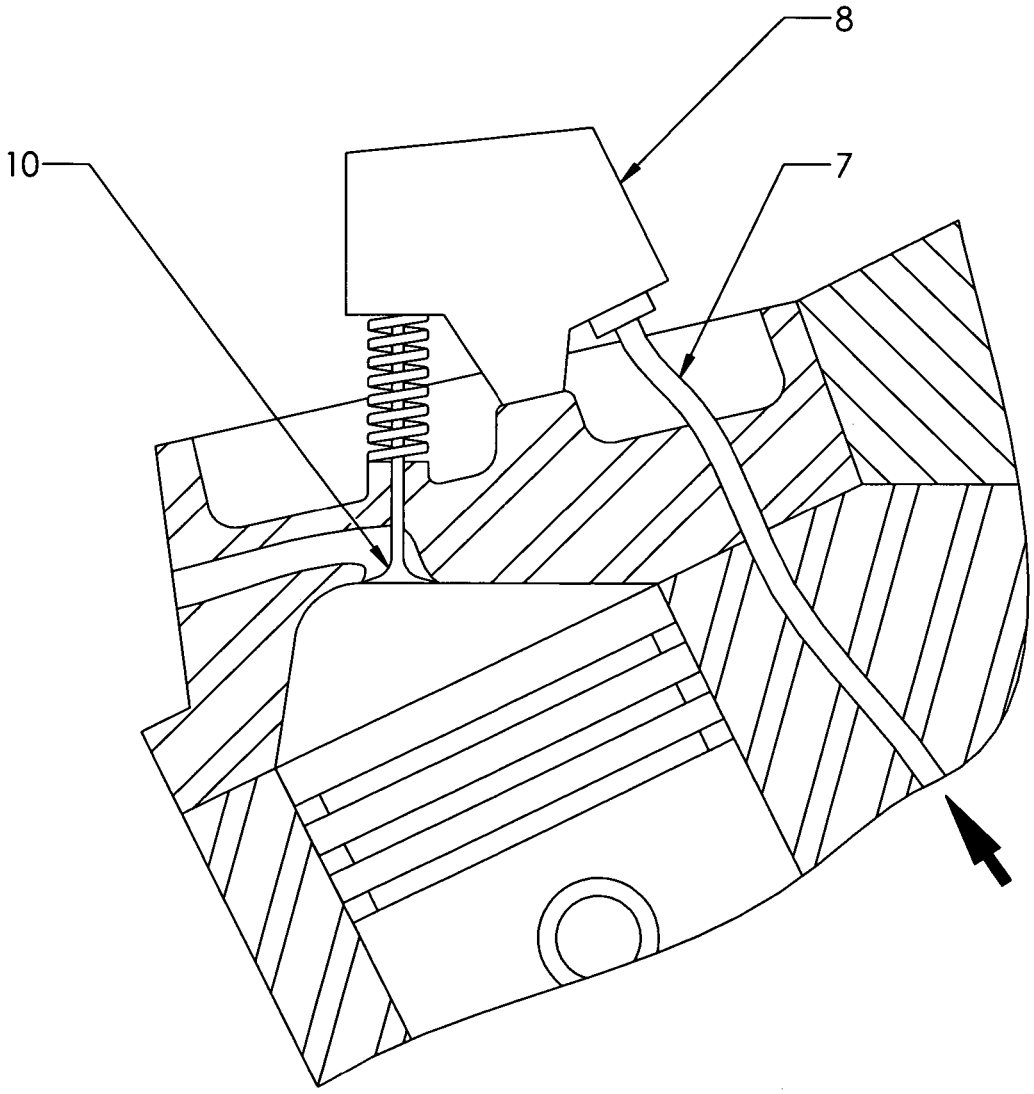
FIG. 5 shows a cylinder head arrangement that may be utilized with the present invention. The figure shows the hydraulic line supplying pressure to a linear hydraulic valve actuator. This pressure is the driving force that will open the valve. Additionally, the present invention can be used in typical rocker arm configurations by utilizing a piston to apply force to the pushrod.

While the following description details the preferred embodiments of the present invention, it is understood that the invention is not limited in its application to the details of construction and arrangement of the parts illustrated in the accompanying drawings, since the invention is capable of other embodiments and of being practiced in a variety of ways and methods. FIG. 1, FIG. 2, FIG. 3, FIG. 4 and FIG. 5, illustrate the variable valve timing device of the present invention. The block assembly is comprised of the two blocks, intake cam follower block, 1, and exhaust cam follower block, 2. These two cam follower blocks are individual casings attached to one another by some means that would allow independent rotation of one in relation to the other, such as a bearing, sleeve or other free moving connection. The two cam follower blocks are housings which encase cylinder bores, fitted with cam followers, 3, which may or may not have rollers at the interface where the cam follower contacts the camshaft. These cam followers displace hydraulic fluid, 4, when moved by means of contact with the camshaft or camshafts, 5. The camshaft is turned at one-half the crankshaft speed via some means of mechanical connection between the camshaft and the engine's crankshaft. The hydraulic fluid displaced through the hydraulic lines, 7, activates the rocker/valve mechanisms or hydraulic valve actuators, 8, to move the engine's valves, 9. With the engine running, the cam follower blocks are rotated angularly by means of some type of actuator 6, that rotates the blocks by means either electrically, hydraulically or some other method and is controlled by an Electronic Control Module (ECM), manually or by other ways. These actuators, can control both the intake block and exhaust block independently, thereby accomplishing the objective of effectively varying the effective lobe separation angle of the camshaft, effectuating operational variances in engine performance, efficiency and emissions output. The intake and exhaust blocks may be designed and manufactured in one piece for collective movement of ALL intake valves and collective movement of ALL exhaust valves, or the blocks may be designed and manufactured as individual, discrete components to allow advancing or retarding of individual valves. These characteristics can be varied with computers or other methods to achieve the desired end effect. A preferred embodiment of the implementation of the present invention may include the hydraulic fluid displaced by the cam followers to be supplied, through a hydraulic line, 7, to some hydraulic valve actuator in order to actuate a valve of an engine, 10.

The invention claimed is:

1. A variable valve timing device for an engine having a crankshaft and a plurality of valves movable between open and closed positions, said variable valve timing device comprising:

a camshaft rotatably coupled to the crankshaft, said camshaft rotates in a fixed orientation relative to the crankshaft;

a plurality of cam lobes defining an eccentric profile and fixedly disposed on said camshaft;

a plurality of blocks each defining at least one bore and configured to independently rotate relative to one another;

means for actuating at least one said block for controlling independent rotation of at least one of said block relative to another one of said blocks;

at least one cam follower operably disposed within at least one said bores and configured to follow said eccentric profile of one of said cam lobes for selectively actuating the valves;

wherein each of said cam followers is adjusted relative to said camshaft independent of other cam followers.

2. The variable valve timing device of claim 1, wherein independent adjustment of at least one said cam followers selectively manipulates timing of opening and closing of at least one said valves.

3. The variable valve timing device of claim 2, wherein said timing of opening and closing of each of said valves is independent of at least one of valve lift and/or duration.

4. The variable valve timing device of claim 1, further including hydraulic fluid or some other alternate liquid and a controller or other means of regulating pressure and flow of said hydraulic fluid for independently adjusting at least one said cam followers.

5. The variable valve timing device of claim 1, wherein said valves are further defined as intake valves and exhaust valves.

6. The variable valve timing device of claim 1, wherein said at least one cam followers further include lifters.

7. The variable valve timing device of claim 1, wherein said at least one cam followers further include pistons.

8. The variable valve timing device of claim 1, wherein said camshaft is further defined as a single-lobe camshaft.

9. The variable valve timing device of claim 1, wherein said camshaft is further defined as a two-lobe camshaft.

10. The variable valve timing device of claim 1, wherein said camshaft is further defined as a multi-intake, multi-exhaust lobe camshaft.

* * * * *